United States Patent [19]

Ono

[11] Patent Number: 4,674,109

[45] Date of Patent: Jun. 16, 1987

[54] ROTATING ANODE X-RAY TUBE DEVICE

[75] Inventor: Katsuhiro Ono, Kawasaki, Japan

[73] Assignee: Kabushiki Kaisha Toshiba, Kawasaki, Japan

[21] Appl. No.: 780,176

[22] Filed: Sep. 26, 1985

[30] Foreign Application Priority Data

Sep. 29, 1984 [JP] Japan ..... 59-204808
Dec. 25, 1984 [JP] Japan ..... 59-278428

[51] Int. Cl.[4] ..... H01J 35/10

[52] U.S. Cl. ..... 378/130; 378/141; 378/144

[58] Field of Search ..... 378/141-144, 378/199, 200, 130

[56] References Cited

U.S. PATENT DOCUMENTS 2,926,269 2/1960 Broad ..... 378/130
4,130,773 12/1978 Kussel ..... 378/144
4,405,876 9/1983 Iverson ..... 378/130
4,468,800 8/1984 Friedel ..... 378/144

*Primary Examiner*—Janice A. Howell
*Attorney, Agent, or Firm*—Oblon, Fisher, Spivak, McClelland & Maier

[57] ABSTRACT

An x-ray tube device with an anode target capable of rotation and a cathode which generates electrons causing them to collide with the target set in a vacuum envelope, and with a shaft which supports and rotates the anode projecting outside the envelope. This x-ray tube device has a structure such that the target is cooled by coolant flowing through coolant channels in the shaft. A vacuum seal is maintained by seal means such as magnetic fluid seal between the envelope and the rotating shaft. The envelope and coolant channels are best maintained at ground potential, and thus have an intermediate potential, with high positive and negative voltages supplied to the anode target and cathode.

9 Claims, 7 Drawing Figures

ROTATING ANODE X-RAY TUBE DEVICE

BACKGROUND OF THE INVENTION

1. Field of the Invention

This invention relates to a rotating anode x-ray tube device.

2. Background of the Prior Art

Ordinary x-ray tubes are used for medical purposes, such as x-ray diagnosis, for example, but for examination of the stomach, etc., x-ray tubes such as the one shown in FIG. 7 are in use. This x-ray tube, a rotating anode x-ray tube, has a cathode 2 at one end of an envelope 1, with a cup 3, containing a cathode filament which emits thermal electrons and focusing electrodes set eccentrically. Towards the centre of the envelope 1, a disc-shaped anode target 4 is set facing the cathode 2. This anode target 4 is set at a large potential difference from the cathode 2 described above, causing the electrons emitted by the cathode filament to accelerate, collide, and produce x-rays by bremsstrahlung. In addition, in order to store and radiate the large amount of heat generated at this point, the anode is made to rotate at a high speed to effectively increase the area over which heat is generated. This sort of anode target 4 is continuous with a closed-end tube-shaped rotor 6, through a supporting rod 5. This rotor 6 is rotated by a rotating magnetic field produced by the stator 7 outside the envelope 1, and thus together they form an inductive motor. The supporting rod 5 and rotor 6 are a single unit. On the inside, rotor 6 has an axle 8 along its axis, and this axle is fixed to the rotor 6 by bolts, etc. (not shown). There is a closed-end tubular stator 9 between this axle 8 and the rotor 6, fixed to the envelope 1 through sealing rings 10, 11. Part of this stator 9 protrudes from the tube, and can be used as an external support and fixing point for the whole x-ray tube. Bearings 12, 13 are positioned between the stator 9 and the axle 8 so as to allow the axle 8 to rotate freely. In operation, when the electrons emitted from the cathode filament arrive at the target, the power reaches 1 kW for an anode voltage 50 kV and current 20 mA. Since more than 99% of this power is converted to heat, the anode is heated to a high temperature even with radiation of heat to the outside and conduction of heat to other components. Because thermal radiation increases in proportion to the 4th power of the temperature, at a high temperature the radiation greatly increases, soon reaching thermal equilibrium. For example, under the above conditions, an equilibrium is reached at 1100° C. after 5 minutes. On the other hand, for heat transmission by conduction, with the other end of the conducting medium thermally free, the end gradually reaches a high temperature over a longer period. Thus, the heat from the target 4 is transmitted by the rotor 6 and axle 8, making them a high temperature. When the rotor 6 reaches a high temperature, thermal radiation increases and a thermal equilibrium is reached in the same way as above. Under the above conditions point B on the supporting rod 5 reaches thermal equilibrium at 800° C. approximately 15 minutes after the power is switched on, point C on the rotor 6 at 550° C. approximately 30 minutes after the power is switched on, and point D close to the bearing 12 at 400° C. approximately 50 minutes after the power has been switched on. If the thermal conductivity of the bearing 12 is lower, the temperature at point D becomes the same as point C, reaching 550° C. The balls in the bearings 12, 13 undergo thermal expansion with their rotation, causing deterioration of the clearances between them and the inner and outer wheels, causing possible problems. Also, if the bearings 12, 13 exceed 500° C., this causes a reduction in the hardness of the balls, leading to tube breakdowns such as the rotation stopping.

With the temperature of the anode target 4 maintained at 800° C.–1200° C. during heat input, the amount of heat radiated from the anode target is different according to surface area, surface emissivity and shape factors, but is normally 2 kw–4 kW. However, if the temperature of the anode target 4 is reduced, since the radiated heat is greatly reduced in proportion to the 4th power of the absolute temperature, it takes a very long time to be sufficiently cooled.

On the other hand, a method for solving this problem, rotating anode x-ray tubes lowering the temperature of the anode target by letting a fluid coolant (eg, water) flow onto the anode target has already been made public in, for example, U.S. Pat. No. 2,926,269 (Broad) etc. These are constructed with the coolant flowing directly into the metal anode target, so that the anode target is maintained at the same earth potential as its housing.

However, existing x-ray tubes such as these have the following defects. As described above, the inner wheel of bearings 12, 13 easily reaches a high temperature, but the outer wheel is at a low temperature. At this point the temperature changes from 60° C. to 550° C. depending on the rotation of the balls in bearings 12, 13. When the balls are at a high temperature, not only does the clearance between the balls and the inner and outer rings become insufficient, but the lubricant between them can vaporize, causing damage to the bearings 12, 13. Because of this there is the defect that stopped rotation breakdowns occur easily and frequently. In order to prevent this, increasing the level of blackening of the target 4, increasing the level of blackening of the rotor 6 surface and providing a thermal shield between the target 4 and the rotor 6 have been suggested, but their effects are relatively small, and definitely make the input power to the target 4 too small.

In addition to this, the permissible temperature of the section of the anode target 4 which is struck by electrons emitted by the electron gun 3 and accelerated with a high voltage (electron incident surface) must be kept below 2800° C. when the anode target 4 is made of tungsten, so as to prevent recrystallization. As above, since the temperature of the anode target as a whole rises to 800°–1200° C., the temperature of the ring-shaped section of the anode target 4 heated by the electrons (electron incident track surface) normally reaches 1200°–1500° C. Accordingly, the maximum value dT for the temperature rise of the electron incident surface due to the electrons striking is limited to 1300°–1600° C., and because the possible input electron beam power, and thus the x-ray output level are proportional to dT, they are restricted to a low value. This is particularly noticeable when the electron incident surface and thus the x-ray focus are small.

Since, as described above, the power of radiation from the anode target 4 reduces in proportion to the 4th power of the absolute temperature when the temperature of the target drops, the speed at which the temperature of the anode target 4 drops is extremely slow, and in order for the anode target 4 to reach a sufficiently low temperature, it must be left for a very long period.

In the case of the example in the above-mentioned Broad Patent (U.S. Pat. No. 2,926,269), because the anode target is at the same earth potential as the housing, for medical use the cathode potential would have to be from 0--150 kV, which not only means that a large and expensive high voltage power source is required, but that the cables are thick and cannot be used in an x-ray device using this x-ray tube.

SUMMARY OF THE INVENTION

The objects of this invention are, firstly, to conduct the anode target heat efficiently to the outside, keep the anode target cooling rate high, and normally maintain the anode target at a low temperature, increasing the permitted power of the input electron beam and thus the x-ray output level, and secondly, provide a revolving anode x-ray tube device which allows a higher voltage supply with the neutral point earth method.

This invention is a rotating anode x-ray tube with the tube vessel divided into a vacuum section and a non-vacuum section by means of a vacuum seal bearing using magnetic fluid or O-ring etc., a cylindrical shaft penetrating the said vacuum seal bearing, and pumping a fluid coolant in and out from the end of this shaft which is outside the vacuum, the other end of the said shaft being inside the vacuum and terminating with an insulator, a metal target fitted to the end of this insulator, cooling the anode target with the coolant through the said insulator, with the anode target electrically insulated from the housing and the coolant, and with the electrical potential of the anode target determined through a conductor on the outer surface of the end of the insulator or through a rotating contact on a central axle.

DETAILED DESCRIPTION OF PREFERRED EMBODIMENTS

Figure 1:
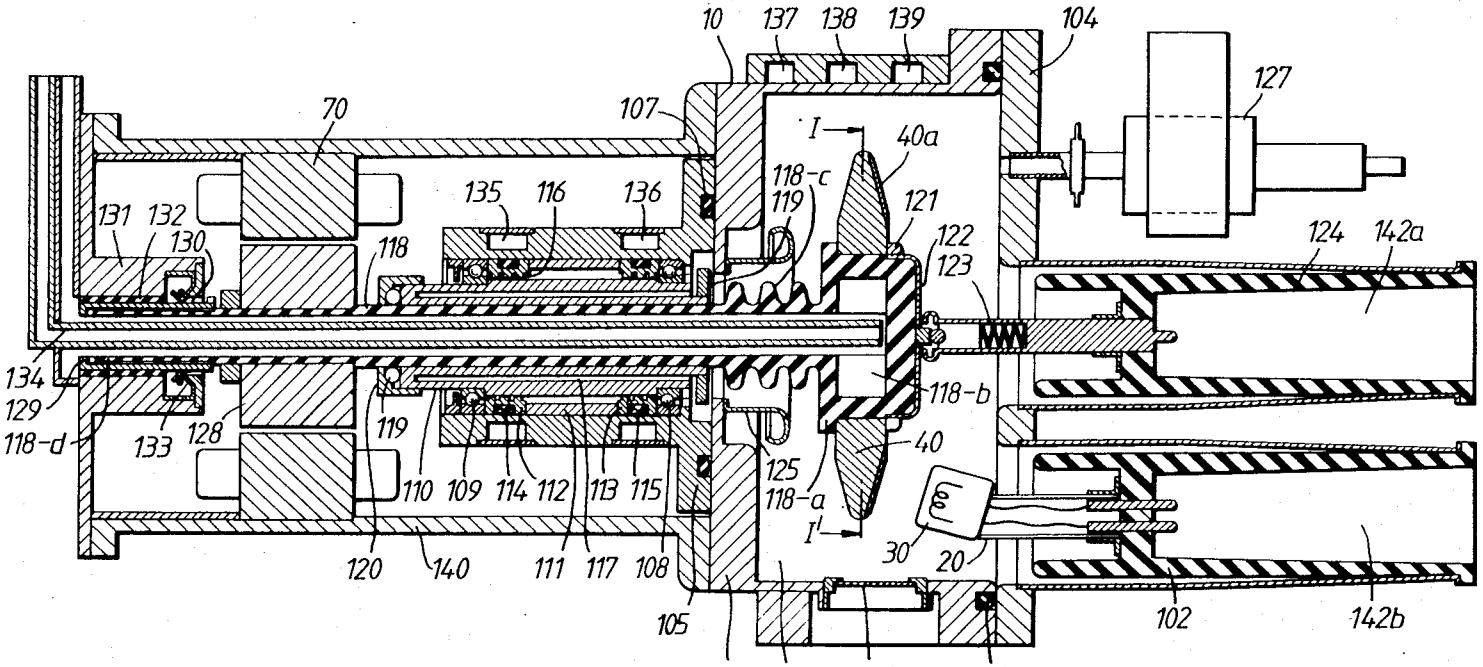
FIG. 1 is a vertical sectional view of an embodiment of the invention.

The rotating anode x-ray tube which is an embodiment of the invention is constructed as shown in FIG. 1.

A vacuum vessel 101 is constructed with the housing 10 made of metal and maintained at earth potential. Inside this vacuum vessel 101 is a cathode 20 which is fixed to the housing 10 via an insulator 102. The housing 10 is made from a central section structure 103, a voltage supply section 104 and a bearing section 105, which are connected to each other via the O-rings 106, 107 so as to be airtight. A shaft housing 110 is fitted to this bearing section 105 with bearings 108, 109. Inside bearing section 105 is fitted a magnet 111 which has been magnetized in the direction of the axle, and at its ends magnetic poles 112, 113 are attached to the bearing section via O-rings 114, 115. A magnetic fluid 116 is spread between magnetic poles 112, 113 and shaft housing 110, allowing free rotation between shaft housing 110 and magnetic poles 112, 113 with a vacuum seal (see U.S. Pat. No. 4,405,876 [Iversen]). Shaft housing 110 is fixed to a shaft 118 and has a central space section 117, and with this central space section being a vacuum, the heat from the shaft is not readily transmitted to the magnetic fluid. The end of the inner cylinder of shaft housing 110 has a groove cut in it, and is affixed with a nut 120. At the back end of shaft housing 110 an O-ring 119 is attached by the clamp nut 120, working as a vacuum seal between shaft housing 110 and shaft 118.

Shaft 118 is made of an insulator with high thermal conductivity, and is an open-ended tube at the atmospheric end, but is closed at the other end, i.e., at a target support section 118-*a*. A target 40 is attached concentrically to target support section 118-*a*. Inside target support section 118-*a* of shaft 118, there is a coolant chamber 118-*b*. Target support section 118-*a* of shaft 118, and consequently target 40 are cooled by the coolant in this coolant chamber 118-*b*. Even if the coolant used is an electrically conducting material such as water, for example, because the coolant and target 40 are electrically insulated, target 40 can be maintained at a different potential from the coolant, if required. Target 40 and target support 118-*a* may be forced together by nut 121 with a suitable flexible gasket (not shown), or may be fixed together by hot pressing, etc. A conductor 122 is fixed to the surface of target support 118-*a* which is made from an insulator, a protrusion made of a hard metal such as SKH9 (JIS standard) is made at the centre of rotation, and an electrical potential is applied to target 40 by contact between this and a contact 123. Contact 123 is fixed to voltage supply section 104 of housing 10 via an insulated tube 124.

In between the bearing section of shaft 118 and the vacuum end target support section 118-*a*, there is a folded section 118-*c* to lengthen the surface distance. Surrounding and concentric to this folded section 118-*c* there is a ring 125, preventing deterioration of the dielectric strength due to impingement of secondary electrons from the electron incident surface of target 40.

An x-ray emission window 126 made of a material with a high x-ray transmission coefficient such as beryllium, for example, is fitted to housing 10. A vacuum pump 127 such as a small ion pump is fitted to the voltage supply section 104 of housing 10. In order that the magnetic field from this vacuum pump 127 does not adversely affect the route of the electrons from an electron gun 30 to target 40, it is magnetically shielded (not shown) by a material with a high permeability such as permalloy.

Rotor 128 of the induction motor is fixed to shaft 118, and is rotated at high speed by the rotating magnetic field produced by a stator 70 which surrounds it. If a fan (not shown) is attached to a rotor 128 or shaft 118, it will be self-cooled. Ring 130 is fixed to an atmospheric side open end 118-*d* of shaft 118 via an O-ring 129. A concentric cylinder 131 is attached around this ring 130, and a bushing 132 made of e.g. resin plastic is fitted between ring 130 and cylinder 131. A coolant seal 133 is fitted concentrically with ring 130 so that coolant does not leak to the outside.

A tube 134 is fitted concentrically inside the shaft 118, and coolant is supplied from the outside to the coolant chamber 118-*b* through tube 134.

There are coolant channels 135, 136 inside bearing section 105, cooling the above-mentioned magnetic fluid 116. There are also coolant channels 137, 138, 139 surrounding housing 10 to absorb the heat radiated by target 40. Stator 70 and cylinder 171 are fixed to housing 10 by a supporting cylinder 140.

Figure 2:
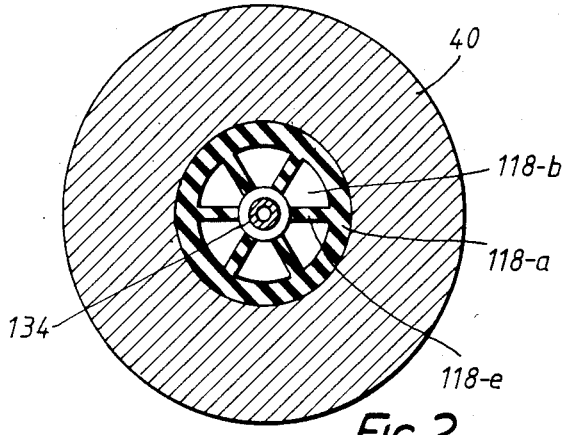
FIG. 2 is a view of section across FIG. 1 along the line I—I'.

FIG. 2 shows a section along line I—I' in FIG. 1, viewed in the direction of the arrows. A coolant chamber 118-*b* is divided by partitions 118-*e*, and the coolant flows separately into each of the coolant chambers 118-*b*.

Figure 3:
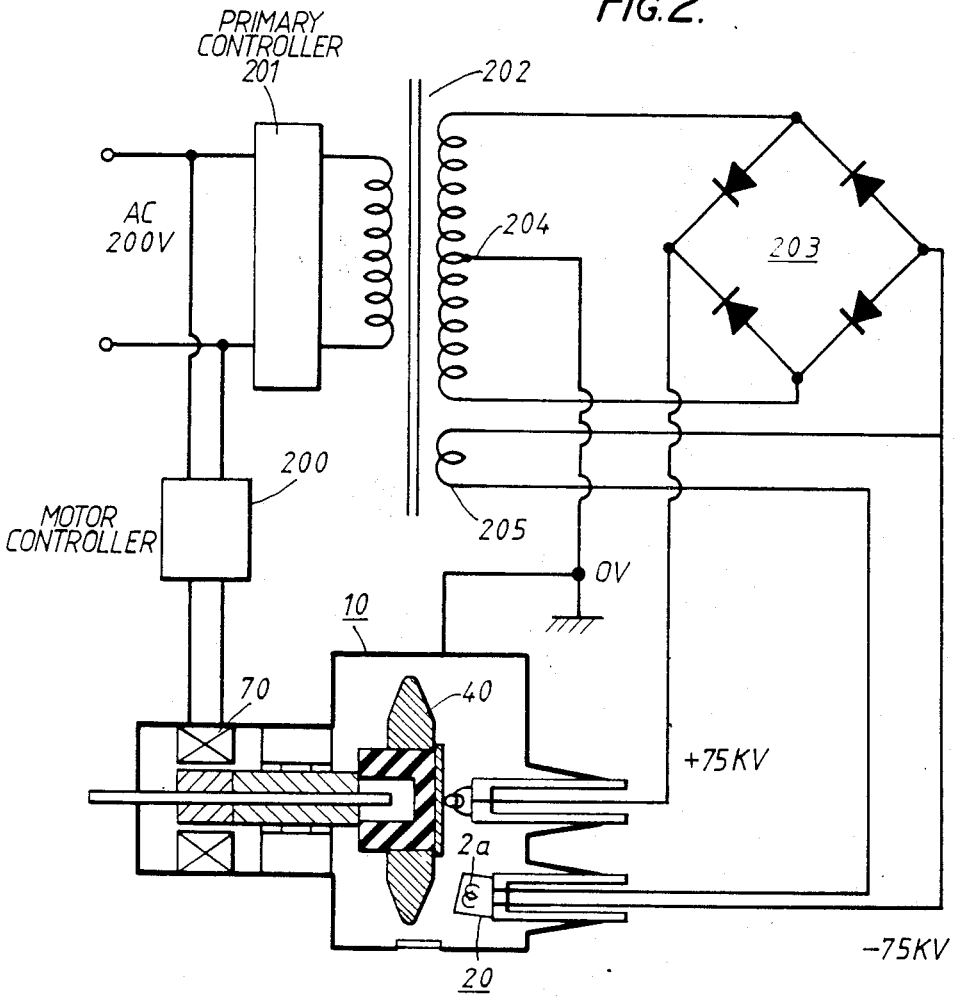
FIG. 3 is a circuit diagram to drive the embodiment in FIG. 1.

In operation, voltage is supplied by the circuit shown in FIG. 3. When the current from a 200 V AC power source is applied to stator 70 via a motor controller 200, shaft 118 and target 40 are rotated at high speed, 10,000–20,000 rpm, by rotor 128. When this happens, target 40 side is maintained at a vacuum by the above-mentioned magnetic fluid 116. An appropriate amount of coolant is supplied from tube 134, collects in coolant chamber 118-*b*, and excess coolant is discharged along the inner walls of shaft 118.

200 V AC is converted to a high voltage by a high voltage transformer 202 through a primary controller 201 which includes a switch, and +75 kV and −75 kV DC are obtained relative to neutral point 204 by means of a high voltage rectifier circuit 203. Neutral point 204 is earthed and connected to housing 10, +75 kV DC is supplied to target 40 through a high voltage supply section 142*a*, and −75 kV is supplied to cathode 20 through a high voltage supply section 142*b*. The current at the electrons generating filament 2*a* of cathode 20 is supplied separately from a secondary winding 205 in high voltage transformer 202. By having housing 10 and coolant lines at earth potential, and supplying high positive and negative voltages to anode 40 and cathode 20, the dielectric strength required for the cables connected to the high voltage supply section is greatly reduced.

The electrons emitted by electron gun 30 are accelerated by the 150 kV potential between target 40 and electron gun, and reach the surface of target 40. The high energy electron beam strikes a tungsten or tungsten alloy plate 40*a* which is stuck to the surface of target 40. When this happens, x-rays are generated at the surface. The heat generated at the same time is quickly transmitted to the middle of target 40 which is made of a heavy metal. The heat from target 40 is then transmitted to the coolant inside coolant chamber 118-*a* of shaft 118 which is made from an insulator with high thermal conductivity. The coolant, pushed by partitions 118-*e*, rotates at high speed along with target 40, and is forced under great pressure against the inner walls of coolant chamber 118-*b* by the strong centrifugal force. Consequently, a vapour layer is prevented from being formed between the coolant and coolant chamber 118-*b*, and the thermal conductivity is high. If the coolant vaporizes due to the temperature rise of the coolant chamber 118-*b* walls, the vapour produced is forced towards the centre of rotation because of the strong centrifugal force acting on the coolant, and is led to the outside along the inner walls of shaft 18. When this happens target support section 118-*a* of shaft 118 is efficiently cooled by the large latent heat of evaporation. The coolant which vaporizes is supplied by tube 134, and coolant chamber 118-*b* is normally filled with coolant.

If water is used as the coolant, then since the internal surface of coolant chamber 118-*b* is normally kept below 120° C., normally heat is readily removed at a rate of around 4 kW. By allowing a certain amount of heat, eg. 500 KHU, to remain in target 40, whilst keeping the surface connected to insulating target support 118-*a* at a low temperature, a large momentary input power can be supplied by permitting a temperature rise in the electron incident track surface. For example, if the design temperature of the electron incident track surface is 500° C. or less, then compared with the conventional device mentioned above, for the same rotational speed and focus size, the peak power which can be input to target 40 is $(2800-500)/(2800-1500)=1.8$ times as large, a great step forwards in terms of performance. Expressed in different terms, the size of the x-ray focus can be reduced to 0.67 times the size for the same x-ray output, greatly improving the resolution of x-ray diagnosis equipment.

Moreover, since the waiting time for the target to drop is less than 200° C. is reduced to 1/10−1/20 compared with that of the pre-existing dsign mentioned above, then if, for example, this is used in CT (Computer Tomography) equipment, the patient processing efficienty can be greatly improved.

In addition, since the rotating mechanism is normally kept at 120° C. or less, reliability is increased and a long product life is achieved. Vibration and noise due to the rotation can also be kept to low levels, and higher rotational speeds are possible than with existing designs.

Furthermore, since target 40 is kept at about +75 kV, housing 10 at OV and electron gun 30 at about −75 kV, the rotating anode x-ray tube in this equipment can be used without any changes to existing x-ray equipment.

Figure 7:
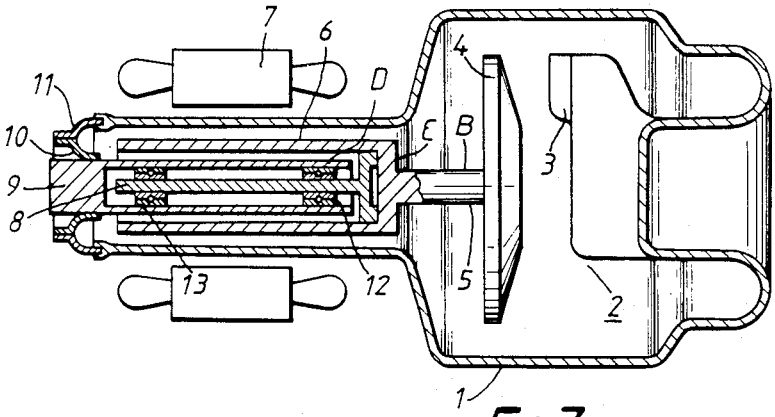
FIG. 7. PRIOR ART
FIG. 7 is a schematic view of an outline section of a conventional device.

The existing design mentioned above (FIG. 7) is fitted inside an x-ray tube envelope (not shown) for operation, but since the rotating anode x-ray tube in this invention can be used just as shown in FIG. 1, it is smaller and lighter than the existing design. The embodiment in FIG. 1 has a total length of 42 cm and a maximum diameter of 20 cm.

A variant of the embodiment has the connection between vacuum end 118-*a* of shaft 118 and target 40 made by metallizing the surface of 118-*a*, which is an insulator, and soldering the two components together. This is desirable because it improves the thermal conductivity.

The height of partitions 118-*e* inside vacuum end 118-*a* of shaft 118 is the same as the internal diameter of shaft 118 in the embodiment, but may also be lower or higher. In addition, they may be completely omitted.

In the embodiment, tube 134 is fitted separately from shaft 118, but shaft 118 and tube 134 may be made as a single unit, or constructed so that tube 134 is supported by shaft 118, with shaft 118 and tube 134 being rotated together. In these cases, of course, a rotary joint (not shown) is necessary for part of tube 134.

By treating the outer surface of shaft 118 from the shaft housing to the atmospheric end with a metallization process, rotor 128 can be kept at earth potential via bearings 108, 109 giving stable operation.

When shaft 118 and shaft housing 110 are fixed, if shaft 118 and one end of shaft housing 110 on the target side are tapered so as to fit together, and a vertical groove is cut into shaft housing 110 near to this joint to give it elasticity, this removes play when it expands due to the heat, and gives it just enough force to prevent the axle wobbling when it is rotating. In addition, if the other end of shaft housing 110 is tightened by inserting a material with a spring action (eg, a cylindrical spring) between shaft 118 and the inside of shaft housing 110, the above effect is further increased.

Rotor 128 and shaft 118 may also be fitted together using the above method. It is of course possible to fit several electron guns 30.

In addition, it is of course possible to improve emissivity by a blackening treatment of part or all of the surface of housing 10 and target 40.

It is also possible to reduce x-ray leakage by sticking a heavy metal such as lead, for example, around housing 10.

If the coolant is kept at a temperature higher than air temperature, eg. 40° C., there is no condensation, improving reliability. A heat exchanger may be fitted so that the coolant flows in a closed loop, and this heat exchanger may be cooled either by water or by forced air.

In the embodiment, high voltage supply section bushing 142*a*, 142*b* is parallel to the tube axis on the end of the vessel facing the rotating shaft, but if one or both of these is fitted perpendicular to the tube axis, it has the effect of reducing the total length of the tube.

Figure 4:
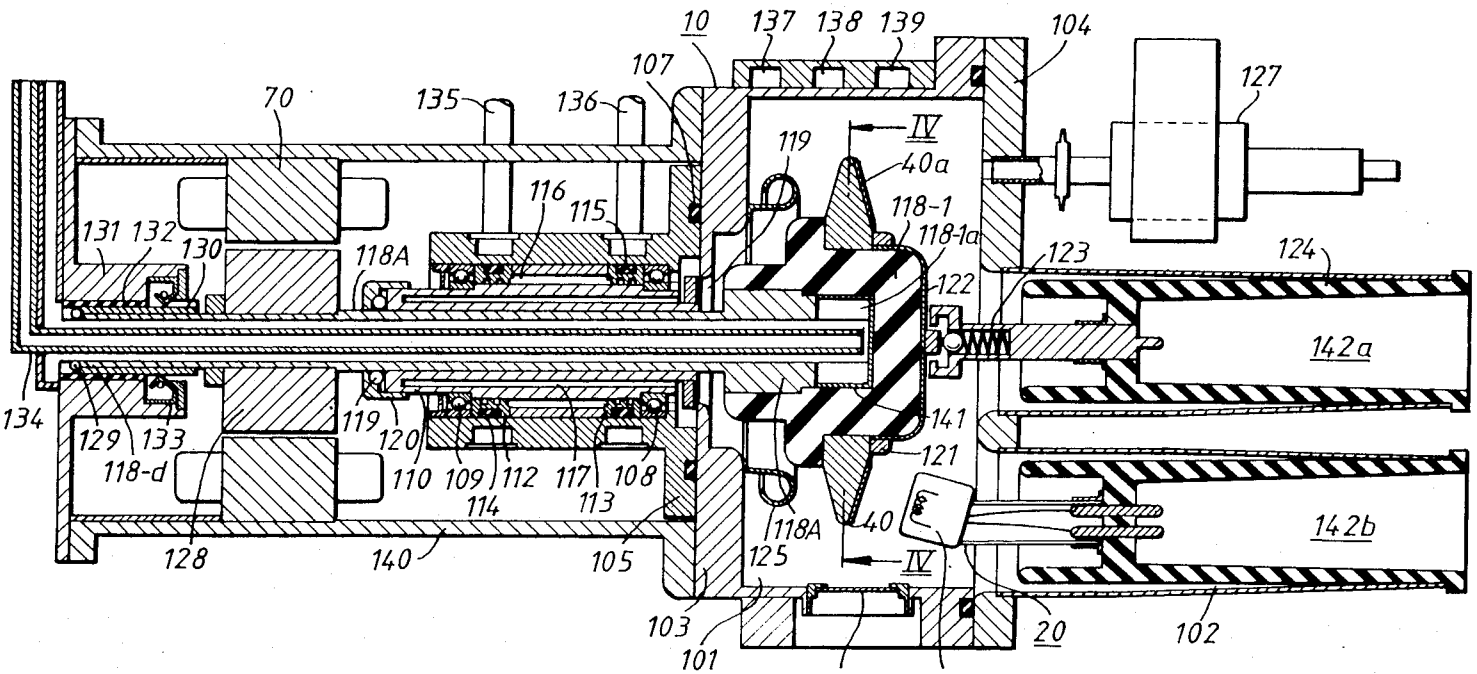
FIG. 4 is a vertical sectional view of another embodiment of this invention.

FIG. 4 shows another embodiment, wherein parts identical and corresponding to FIG. 1 are denoted with like reference numerals.

This embodiment uses a tubular metal shaft 118A made from stainless steel or a similar material instead of the insultating shaft 118 of the embodiment in FIG. 1. Shaft 118A has a large diameter cylinder 118A-*a* at the target 4 end, and holds a target support section 118-1 made of AlN. Target support section 118-1 takes the form of a tube with a closed bottom, and a chamber is formed between it and the large diameter cylinder 118A-*a*. The inner walls of target support section 118-1 chamber are covered with a metal layer 141. Tube 134 passes down the centre of shaft 118A, and ends in a chamber 118-1-*a*. The 2-way flow channel made by shaft 118A and tube 134 is continuous with chamber 118-1-*a*.

Figure 5:
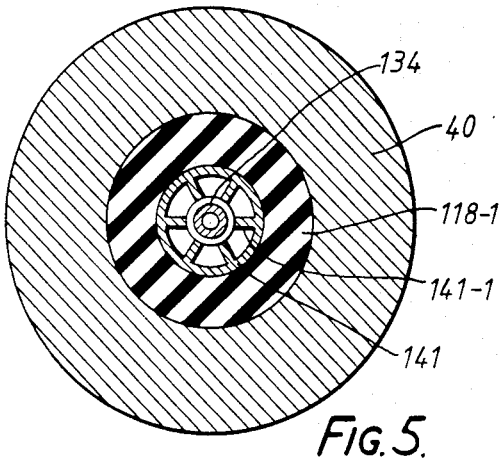
FIG. 5 is a view of section across FIG. 4 along the line IV—IV.

As shown in FIG. 5, a chamber 118-1-*a* is divided into several small chamber structures by metal plates 141-1 stretching from the metal layer 141 towards a tube 134.

In operation, when a shaft 118A and target 40 rotate at high speed, 10,000–20,000 rpm, the coolant pumped into shaft 118A revolves at high speed in these small chambers together with a target support 118-1, and is forced against metal layer 141 under high pressure due to the strong centrifugal force. Thus, the formation of steam at the surface of metal layer 141 is prevented, so a metal plates 141-1 increase the cooling effect as well as improving heat conduction.

Apart from being stronger than the insultating shaft, the metal shaft has the advantage of being easy to connect to other metal components. For example, breakdowns due to vacuum leaks, etc., can be prevented by a good connection with metal layer 141. Moreover, since it can be easily processed, shaft 118 alone can be made into a 2-way coolant channel. For example, shaft 118 itself may be made into a 2-way coolant path by making lots of holes almost parallel to the axis and making another rotary seal around the holes in the central section on the outside of rotary seal 133.

It is also possible to cover the end of tube 134, make small holes near to coolant chamber 118-1-*a*, and obtain a structure which sprays coolant out as a mist. The cooling efficiency of the chamber section can be further increased by this method.

The joint between vacuum end 118-*a* of shaft 118 and anode target 40 may be made by metallizing the surface of 118-*a* which is made from an insulator, and then soldering them together, or by exchanging metal layer 141 for a thick metal cap and making it in advance as a single unit with shaft end section 118-*a*, or soldering to maintain a vacuum and then fitting insulating target support section 118-1. If this is done, there is no need for an air-tight seal between shaft 118 and target support section 118-1.

It is of course possible to construct a second bearing on the other side of shaft housing 110 from anode target 40, passing the coolant through it after it has been through anode target 40.

Figure 6:
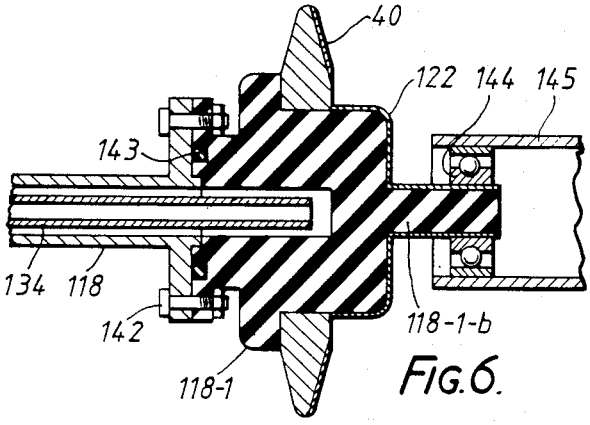
FIG. 6 is a cross sectional view of essential parts of further embodiment of the invention.

Next, another variation using a metal shaft is described with reference to FIG. 6. This variation has the same effect as the embodiment described above, and the same symbols are used to similar items.

Shaft 118-A and target support section 118-1 are tightly fixed mechanically by bolts 142. Between them there is an O-ring forming a seal for the coolant. There is a projection 118-1-*b* on the end of target support section 118-1, with an electrically conducting material attached to its surface. A ball bearing 144 is fitted in contact with this. This bearing reduces friction in the vacuum using a solid lubricant. Bearing 144 is supported by support tube 145, and this support tube 145 is fixed to the voltage supply section 104 of the housing via insulating tube 124. A high voltage is then supplied to anode target 40 through the above-mentioned metal layer 122, bearing 144 and support tube 145.

Good results are obtained if $Si_3N_4$ is used for the target support 118-1, since it has a high rate of heat radiation, has good mechanical strength and is easy to joint to metals. On the other hand, if AlN is used for the target support 118-1, thermal conductivity is good and cooling improves.

The anode target 40 may also be cooled by constructing a heat pipe inside shaft 118A, and cooling the section of shaft 118 which is outside the vacuum.

By means of this invention, the following outstanding results are obtained.

1. The cooling rate of anode target 40 is normally at a high value, the time taken for anode target 40 to cool sufficiently is reduced by a factor of several tens, and it can be used for extremely heavy duties. Because of this, if, for example, it is used in a CT (Computer Tomography) device the patient processing efficiency (patient throughput) is greatly improved.

2. Since anode target 40 is normally kept at a low temperature, the permissible momentary input (with the same rotational speed, target size and focus) is improved by 1.8 times, the focus size is reduced to 0.67 times for the same X-ray output, and when used in X-ray diagnosis equipment, the resolution is dramatically improved.

3. By operation with anode target 40 at a high positive voltage, housing 10 at earth potential and electron gun 30 at a high negative voltage, an existing neutral point earth high voltage power source can still be used whilst keeping the above effects, and the invention can be applied to X-ray diagnosis equipment without requiring any alternations.

4. Because bearing 105 can be kept at a low temperature, it becomes extremely reliable, and a low-vibration, low-noise, long-lift X-ray tube can be produced.

5. Because housing 10 doubles as the envelope, the tube is small and lightweight.

6. Since housing 10 is built to be demountable, faulty components can be replaced, reducing costs.

7. Because the temperature of bearing 105 is low, high rotational speeds are possible, and the X-ray output can be further increased.

What is claimed is:

1. A rotating anode X-ray tube device comprising:

a vacuum vessel;

cathode means arranged in said vacuum vessel for emitting electrons;

a rotatable anode target positioned in said vacuum vessel and facing said cathode means;

an electrically insulating target support section supporting said anode target and having an internal coolant chamber with walls;

a rotating shaft rotatably coupled with said target support section and having internal coolant channels for permitting coolant to flow into and out of said coolant chamber, said coolant channels having means for supplying coolant to said walls of said internal coolant chamber whereby said target is cooled via said chamber;

a cylindrical bearing section fixed to said vacuum vessel, said rotating shaft passing through said bearing section;

a cylindrical shaft housing positioned inside said cylindrical bearing section and vacuum-tightly fixed on said rotating shaft, said shaft housing including means for shielding heat transmission from said rotating shaft;

mechanical bearings interposed between said cylindrical bearing section and said cylindrical shaft housing;

magnetic fluid seal means for vacuum-tightly sealing said vacuum vessel, said fluid seal means being interposed between said cylindrical bearing section and said cylindrical shaft housing;

first potential supplying means for supplying a high positive voltage from the outside to said target;

second potential supplying means for supplying a high negative potential to said cathode means; and potential maintainin means for maintaining the vacuum vessel at an intermediate potential.

2. The device of claim 1, wherein said heat shielding means of said cylindrical shaft housing comprise a double walled cylindrical member with space between the double walls thereof.

3. The device of claim 1, wherein an inner diameter of said internal coolant chamber is larger than an outer diameter of said rotating shaft.

4. A rotating anode X-ray tube device according to claim 1, including a stator and a rotor which form a rotary drive for the rotating shaft, said stator and rotor being arranged at a position on the rotating shaft further from the target than the magnetic fluid seal and at atmospheric pressure.

5. A rotating X-ray tube device according to claim 1, wherein the rotating shaft is an insulating tube with said target support section constructed as an extension of said rotating shaft.

6. A rotating anode X-ray tube device according to claim 1, wherein the rotating shaft is made of metal.

7. A rotating anode X-ray tube device according to claim 1, wherein the target support section is made of one from the group consisting of silicon nitride and aluminum nitride.

8. A rotating anode X-ray tube device according to claim 1, including high voltage bushings comprising the first potential supplying means and being set at an opposite end of the housing from the rotating shaft.

9. A rotating anode X-ray tube device according to claim 1 wherein said intermediate potential is set at ground potential.

* * * * *